United States Patent [19]

James

[11] Patent Number: 4,901,556

[45] Date of Patent: Feb. 20, 1990

[54] LOADING A SEGMENTED DIE AND EJECTING A COMPONENT FORMED THEREIN

[75] Inventor: Stephen R. James, Astwood Bank, England

[73] Assignee: PFD Limited, Birmingham, England

[21] Appl. No.: 312,771

[22] PCT Filed: Dec. 3, 1987

[86] PCT No.: PCT/GB87/00875

§ 371 Date: Jan. 23, 1989

§ 102(e) Date: Jan. 23, 1989

[87] PCT Pub. No.: WO88/04207

PCT Pub. Date: Jun. 16, 1988

[30] Foreign Application Priority Data

Dec. 6, 1986 [GB] United Kingdom ..... 8629226

[51] Int. Cl.[4] ..... B21J 13/08

[52] U.S. Cl. ..... 72/346

[58] Field of Search ..... 72/344, 346; 10/11 E, 10/11 T

[56] References Cited

U.S. PATENT DOCUMENTS

| | | | |
|---|---|---|---|
| 2,787,828 | 4/1957 | Cousino . | |
| 2,987,932 | 4/1961 | Frueauff . | |
| 3,120,769 | 2/1964 | Hatebur . | |
| 4,693,109 | 9/1987 | Connor et al. | 72/344 |

FOREIGN PATENT DOCUMENTS

| | | |
|---|---|---|
| 1044 | 1/1984 | Japan . |
| 6238 | 1/1985 | Japan . |
| 1376547 | 12/1974 | United Kingdom . |

*Primary Examiner*—Lowell A. Larson

*Attorney, Agent, or Firm*—Marshall, O'Toole, Gerstein, Murray & Bicknell

[57] ABSTRACT

A method, and apparatus, for removing a formed component (5) from a die (6) and reloading the die with a fresh billet (4) to form another component, wherein the fresh billet is forced into the die from below causing the die to be raised from a die block and engage a member (42) which separates the die into segments. When the die is thus separated, the component disengages from the segments permitting them to return to the die block with the fresh billet therein. The component is held on top of the die to be removed by a transfer mechanism.

16 Claims, 7 Drawing Sheets

LOADING A SEGMENTED DIE AND EJECTING A COMPONENT FORMED THEREIN

This invention relates to apparatus and a method for ejecting a die-formed component from a segmented die and reloading the die with a fresh billet from which another component is to be formed, in particular where the die-formed component is locked into the die and is releasable only by separating the segments of the die. In the embodiment hereafter described by way of example, the component is an inner member for a cross-groove type of constant velocity ratio universal joint.

The object of the invention is to enable the cycle of ejecting the die-formed component and reloading the die with a corresponding fresh billet to be performed more rapidly than hitherto.

According to a first aspect, the invention provides apparatus for use in die-forming components, comprising:

a segmented die comprising a number of circumferentially disposed segments defining an axial bore between end faces thereof shaped to receive successive billets, and a transversely-extending cavity communicating with the bore into which the billet flows under axial compression as a component is formed;

a die block shaped to receive the die;

ejection/load apparatus for ejecting a formed component from the die and reloading the die with a corresponding fresh billet from which another component is to be formed, comprising means for feeding a fresh billet to one end of the said bore with the die block positioned at an injection/load station, and means for plunging the fresh billet through the bore to abut against one of said components formed and locked in the die thus to force the die partially out of the die block to permit separation of the die segments, and, on separation of the die segments sufficiently to release the component from the die, to plunge the fresh billet further in the same direction through the opened die to push the component free of the die and permit the die to return to the die block;

and means for removing the freed component from the ejection/load apparatus once the die has returned to its closed state received in the die block.

According to a second aspect, the invention provides apparatus for ejecting a die-formed component from a segmented die positioned at an ejection/load station and reloading the die with a fresh corresponding billet from which another component is to be formed, the die comprising a number of circumferentially disposed segments received in a die block and defining an axial bore between end faces thereof shaped to receive successive billets, and transversely-extending cavity communicating with the bore into which the billet flows under axial compression as the component is formed, the apparatus comprising:

means for feeding the fresh billet to one end of the said bore;

means for plunging the fresh billet axially through the bore to abut against the component formed and locked in the die thus to force the die partially out of the die block to permit separation of the die segments, and, on separation of the die segments sufficiently to release the component from the die, to plunge the fresh billet further in the same axial direction through the opened die to push the component free of the die and permit the die to return to the die block;

and means for engaging and resiliently biasing the component axially towards the die centre, in opposition to the direction of action of the plunging means, to force the fresh billet into the bore, and the component onto an end face of the die adjacent one end of the bore, once the component has been freed from the die.

Such apparatus, according to either aspect of the invention, is capable of operating automatically and cyclically in conjunction with a press for compressing the billet within the die to form the component. By combining the reloading of the die with a fresh billet with the ejection of the previously-formed component from the die in the manner described, the apparatus is capable of operating particularly rapidly.

According to a third aspect, the invention provides a method of ejecting a die-formed component from a segmented die and reloading the die with a fresh corresponding billet, the die resting in a die block and having a bore between end faces thereof shaped to receive successive billets, and transversely-extending cavities communicating with the bore into which the billet flows under axial compression, comprising:

feeding a fresh billet to one end of said bore;

plunging the fresh billet through the bore to abut against a component formed and locked in the die and thus to force the die partially out of the die block;

separating the die segments sufficiently to release the component from the die, and continuing to plunge the fresh billet further in the same direction through the opened die to push the component free of the die;

allowing the die to return to its closed state resting in the die block with the fresh billet held in the said bore;

and removing the freed component.

Finally, according to a fourth aspect, the invention provides a method of forming components from corresponding billets in a segmented die having a bore between end faces thereof shaped to receive successive billets, and transversely-extending cavities communicating with the bore into which the billet flows under axial compression, comprising the steps of:

(a) forming a component within the die by compressing a billet axially so that it flows into said cavities, said die resting in a die block;
(b) feeding a fresh billet to one end of said bore;
(c) plunging the fresh billet through the bore to abut against the said component and thus to force the die partially out of the die block;
(d) separating the die segments sufficiently to release the component from the die, and continuing to plunge the fresh billet further in the same direction through the opened die to push the component free of the die;
(e) allowing the die to return to its closed state resting in the die block with the fresh billet held in the said bore;
(f) removing the freed component; and
(g) cyclically repeating steps (a) to (f) above with successively-loaded billets.

In order that the invention may be better understood, a preferred embodiment thereof will now be described, by way of example only, with reference to the accompanying diagrammatic drawings, wherein.

Figure 1:
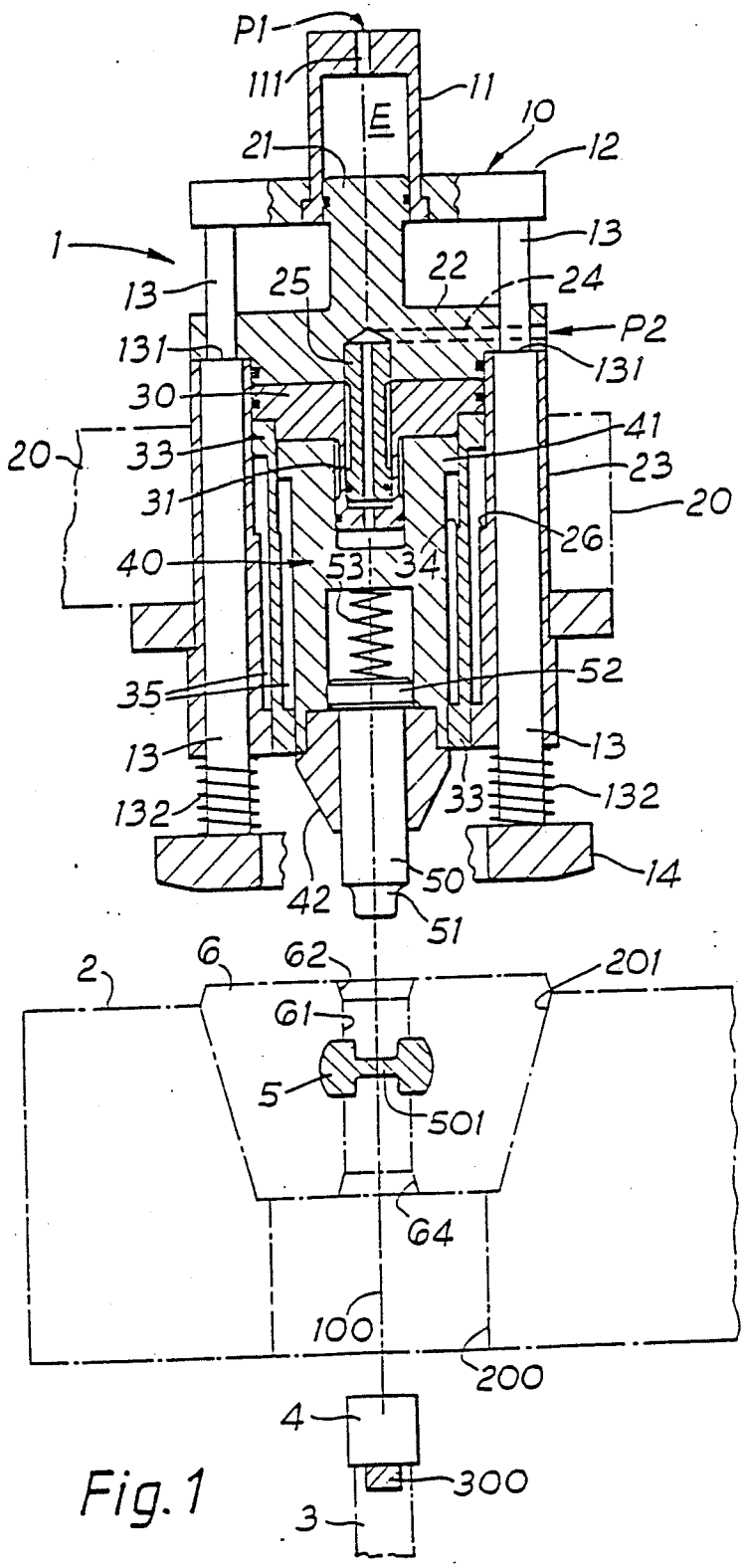
FIGS. 1 to 6 are all vertical sections through the axis of apparatus embodying the invention for ejecting from a segmented die the inner member of a cross-groove type universal joint which has been formed in the die, and for reloading the die with a fresh corresponding billet, the process of ejecting and reloading being shown in successive stages in FIGS. 1 to 6.
Figure 2:
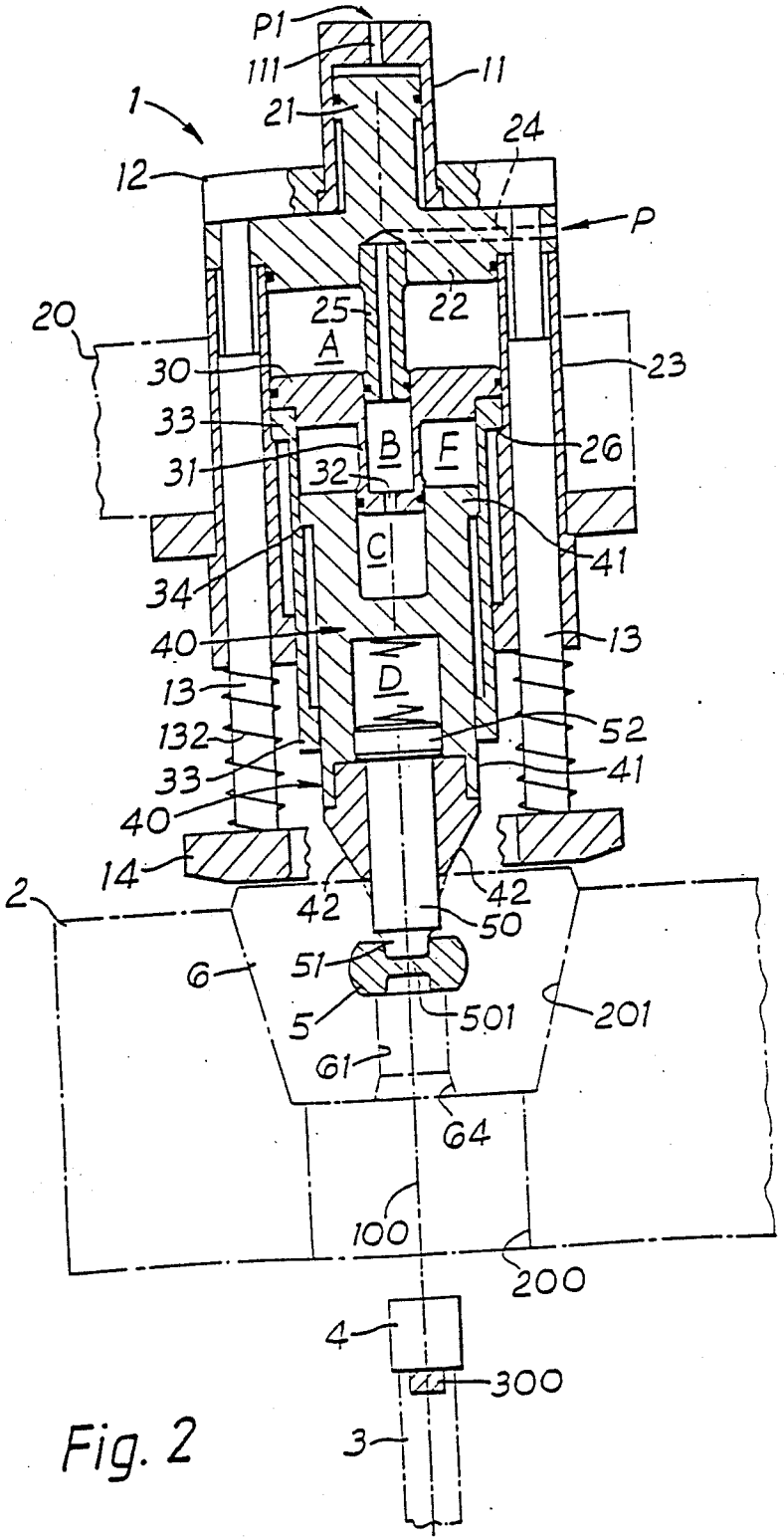

With reference first to FIGS. 1 and 2, a segmented die 6 resting in a die block 2 with a complementary recess 201 is movable transversely of a vertical axis 100 to an ejection/load station at which ejection/load apparatus 1 on the vertical axis 100 is positioned directly above the die 6. The die block 2 has a cylindrical bore 200 on the vertical axis 100 to provide access to the underside of the die 6.

The segmented die 6 comprises, in this example, six segments disposed angularly around the vertical axis 100, the segments being separable radially when the die is released from the die block 2. The die 6 has a cylindrical axial bore 61 with tapered ends 62, 64. At the die centre, the bore 61 widens into a die cavity (500, FIG. 4) defining the final configuration of the inner member 5 of a cross-groove type universal joint. The configuration of the inner member 5 is such that it can be released from the die 6 only by separation in the radial direction, hence the need for die segments of the type described.

The inner member 5 is formed in the die at a press, as described below with reference to FIG. 7, from a corresponding billet 4 of a cylindrical configuration, of a metal which is sufficiently soft to flow into the die cavity 500. The inner member 5 is intended to have a cylindrical bore formed by rams at the die press; in fact, as shown in FIGS. 1 to 6, a narrow disc 501 is left centrally of the inner member 5, and this is subsequently removed at a separate piercing station, described below with reference to FIG. 7.

Figure 3:
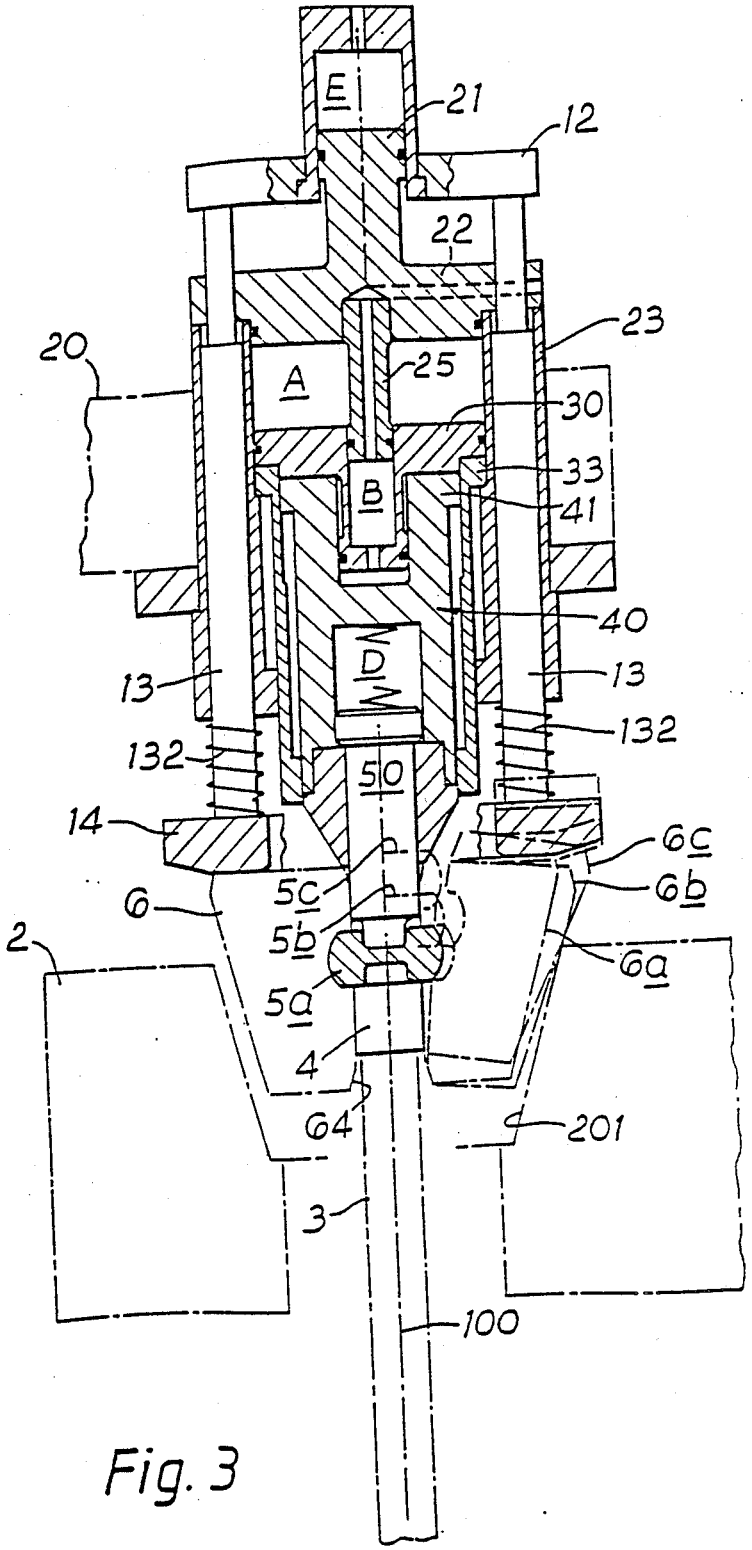
Figure 4:
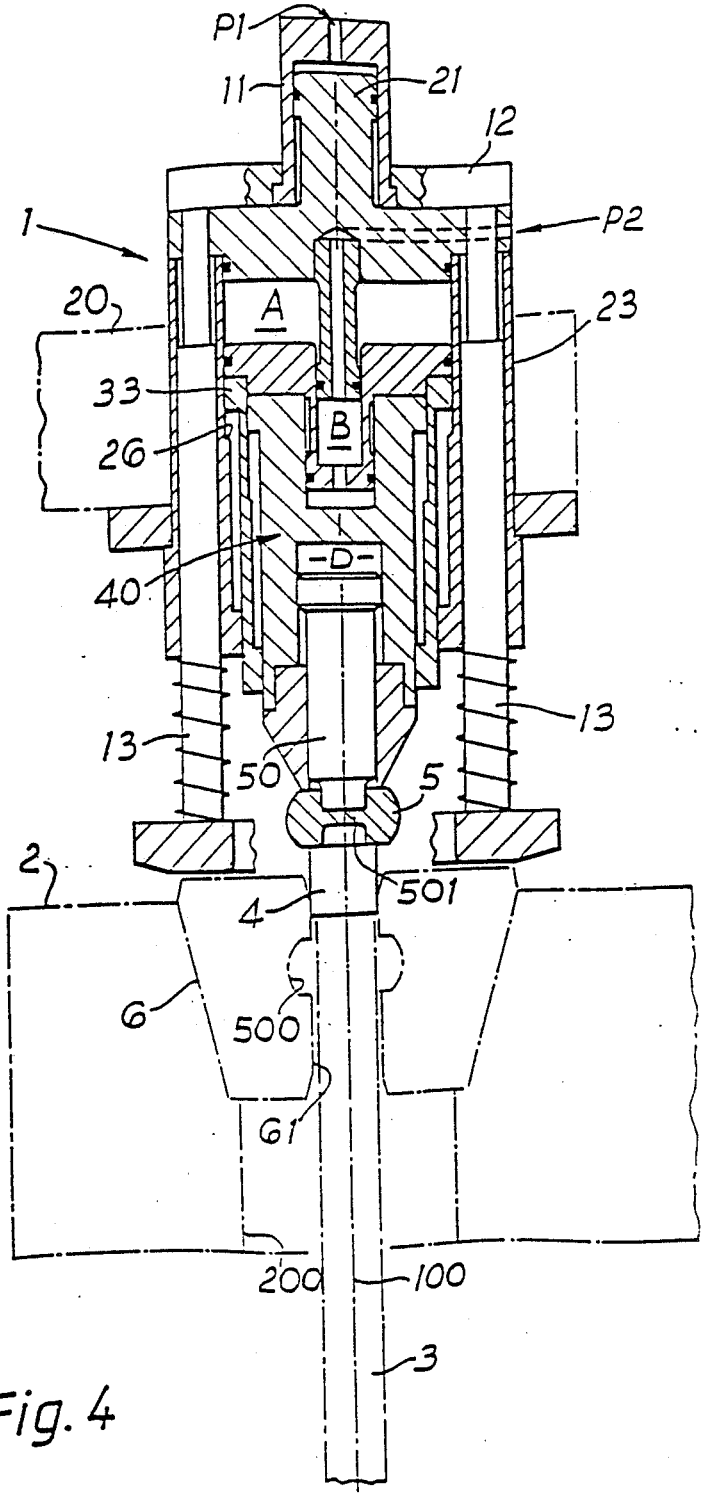

The ejection/load apparatus 1 includes a vertically-operable plunger 3 which is driven hydraulically to reciprocate between the retracted position shown in FIGS. 1 and 2 and the extended position shown in FIG. 4. The head of the plunger 3 is cylindrical and has a disc-shaped recess accommodating a permanent disc magnet 300 for holding successive fresh billets 4 onto the plunger 3. Apparatus for feeding successive fresh billets to the plunger 3 is not shown in FIGS. 1 to 6, but is shown and described below with reference to FIG. 7.

The remainder of the ejection/load apparatus 1 is situated above the plunger 3, and will now be described in detail with reference primarily to FIGS. 1 and 2. The ejection/load apparatus 1 comprises a stationary frame 20 to which is fixed a main body 23 of generally cylindrical form closed with an upper body portion 22 from which extends vertically upwards a stationary piston 21.

A die-retaining assembly 10 is connected to the main body 23 and constrained to relative vertical axial movement. The die-retaining assembly 10 comprises an annulus 14 disposed on the axis 100 for engaging the peripheral portion of the upper surface of the die 6. The annulus 14 is connected to at least two vertical legs 13 extending through corresponding bores in the main body 23, the upper ends of all the legs 13 being connected to a disc 12. A pneumatic cylinder 11 is connected to the centre of the disc 12 and is disposed on the vertical axis 100 to cooperate with the stationary piston 21. The pneumatic cylinder 11 is open downwardly to receive the stationary piston 21, which slides axially therewithin, and has a bore 111 through its closed upper end to define a first port P1 for connection to a source of pressurised air. The annulus 14 is resiliently biased downwardly by a coiled compression spring 132 threaded over each leg 13 between the upper surface of the annulus 14 and the underside of the main body 23. Each leg 13 has an upper portion of lesser diameter than the main portion, the join between these portions defining an annular shoulder 131 (FIG. 1). The upper limit of travel of the annulus 14 relative to the ejection/load station is defined by the axial position of the shoulders 131 which abut against the upper body portion 22. The annulus 14 may be retracted from engagement with the die 6, against the action of the compression springs 132, by the supply of air under pressure to port P1 into the chamber E within the cylinder 11, which air pressure reacts against the stationary piston 21 and lifts the die-retaining assembly 10.

As shown in FIG. 1, the main body 23 has a generally cylindrical bore open downwardly; an upper half of the bore is slightly wider than a lower half, the join between the two halves defining an annular shoulder 26 (FIG. 1). An intermediate member 30, 31, 33 slides within the main body 23. The intermediate member comprises a cylinder 33, open at its lower end, but closed at its upper end by an end closure 30, 31 (FIG. 2). The end closure 30 is generally T-shaped in axial section, an axial extension 31 defining a pneumatic cylinder B. A further, downwardly-extending stationary piston 25, connected to the upper portion 22, is received within the pneumatic cylinder B for relative sliding movement on the vertical axis 100. As the intermediate member 30, 33 moves relative to the stationary main body 23, so the downwardly-extending stationary piston 25 moves within the stationary pneumatic cylinder B. The upper limit of travel of the intermediate member 30, 33 is provided by the abutment of the upper surface of the end closure 30 against the underside of the upper body portion 22, as shown in FIG. 1. The lower limit of travel of the intermediate member 30, 33 is defined by the annular shoulder 26 against which the annular head of the intermediate member abuts, as shown in FIG. 2.

The space A between the intermediate member 30, 33 and the stationary upper body portion 22 acts as an air spring, and is supplied with air under pressure from a port not shown. A port P2, by way of a bore 24 extending horizontally through the upper body portion 22 and axially through the downwardly-extending stationary piston 25, supplies air to the cylinder B.

A camming piston 40 is carried by the intermediate cylinder 33 for relative axial sliding movement therewithin. The camming piston 40 has a main body portion 41 which acts as a piston within the intermediate cylinder 33. The widened head of this main body portion 41 slides against the inner cylindrical wall of the upper portion of the intermediate cylinder 33 which is of slightly wider internal diameter than a lower portion thereof, the two portions of different diameter being separated by an annular shoulder 34. A cylindrical recess in the upper portion of the main body 41 of the camming piston 40 forms a pneumatic chamber C (FIG. 2) within which slides the piston 31 formed as a downwards axial extension of the end closure 30 of the intermediate member 30, 33. A bore 32 provides permanent communication between the two adjacent chambers B, C, as shown in FIG. 2. The annular chamber F between the camming piston and the intermediate cylinder is vented to the atmosphere, by means not shown. The annular cylindrical chambers 35 (FIG. 1) between the camming piston 40 and the intermediate cylinder 33, and between the intermediate cylinder 33 and the stationary main body member 23, form air spring pockets and are not vented to the atmosphere. Alternatively coil springs would be disposed in such annular chambers.

The upper limit of travel of the camming piston 40 relative to the intermediate member 30, 33 is defined, as shown in FIG. 1, by the abutment of its upper end surface against the annular undersurface of the end closure 30. The lower limit of relative movement of the camming piston 41 is defined by the abutment of its widened piston head against the annular shoulder 34.

The main body portion 41 of the camming piston 40 is connected to a cone portion 42 with a cylindrical axial bore and a frusto-conical camming surface which tapers inwardly and downwardly. The external diameter of the lower end surface of the cone portion 42 is slightly smaller than the internal diameter of the tapered portion 62 of the bore in the die 6, to enable the cone portion 42 to engage in the bore 62 and to force the die segments apart radially by relative axial movement.

The camming piston 40 carries an inner piston 50 whose head 52 slides axially within a cylindrical axial bore D formed in the main body portion 41 of the camming piston 40. The inner piston 50 has a main cylindrical portion which extends through the axial bore in the cone portion 42. As shown in FIG. 1, a coiled compression spring 53 is disposed axially in the chamber D to bias the inner piston 50 resiliently downwards relative to the camming piston 40, to the lowermost position at which the piston head 52 of the inner piston 50 abuts the annular upper surface of the cone portion 42, whose internal bore is narrower than the diameter of the piston head 52. A button 51 projecting axially downwardly from the inner piston 50 is shaped so as to engage in the upper facing cylindrical recess in the inner member 5 formed in the die 6. The purpose of the inner piston 50 is to steady the inner member 5 during its movement out of the die 6, as will be explained in greater detail below.

Figure 5:
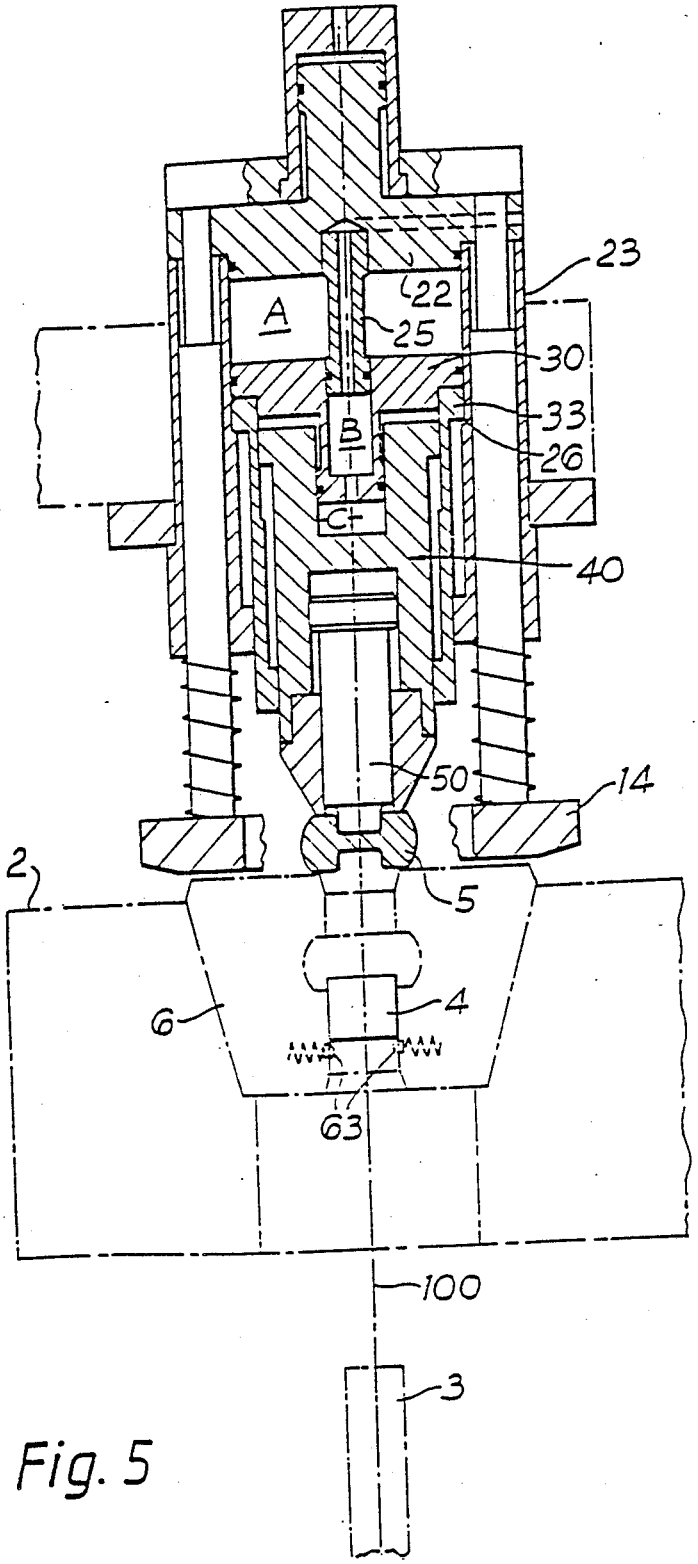
Figure 6:
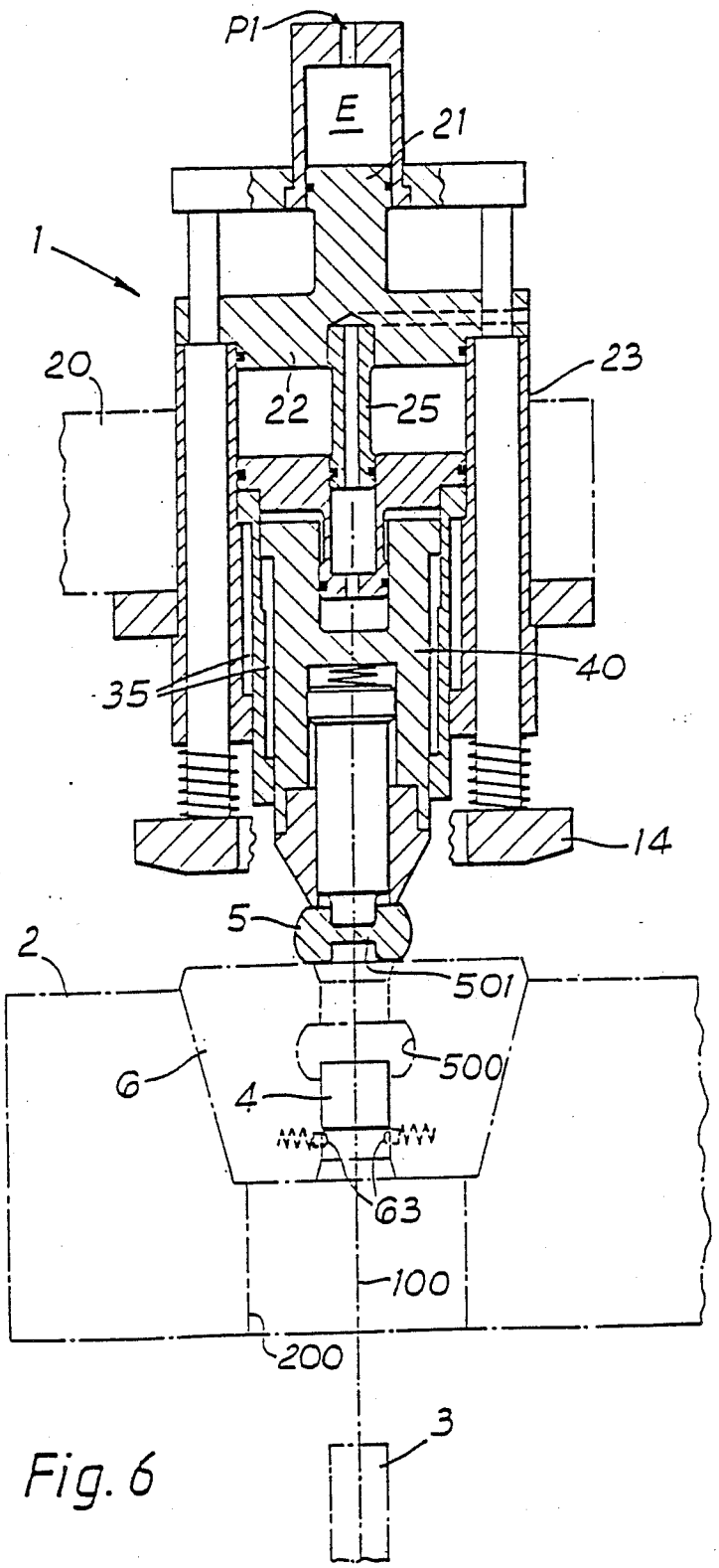
Figure 7:
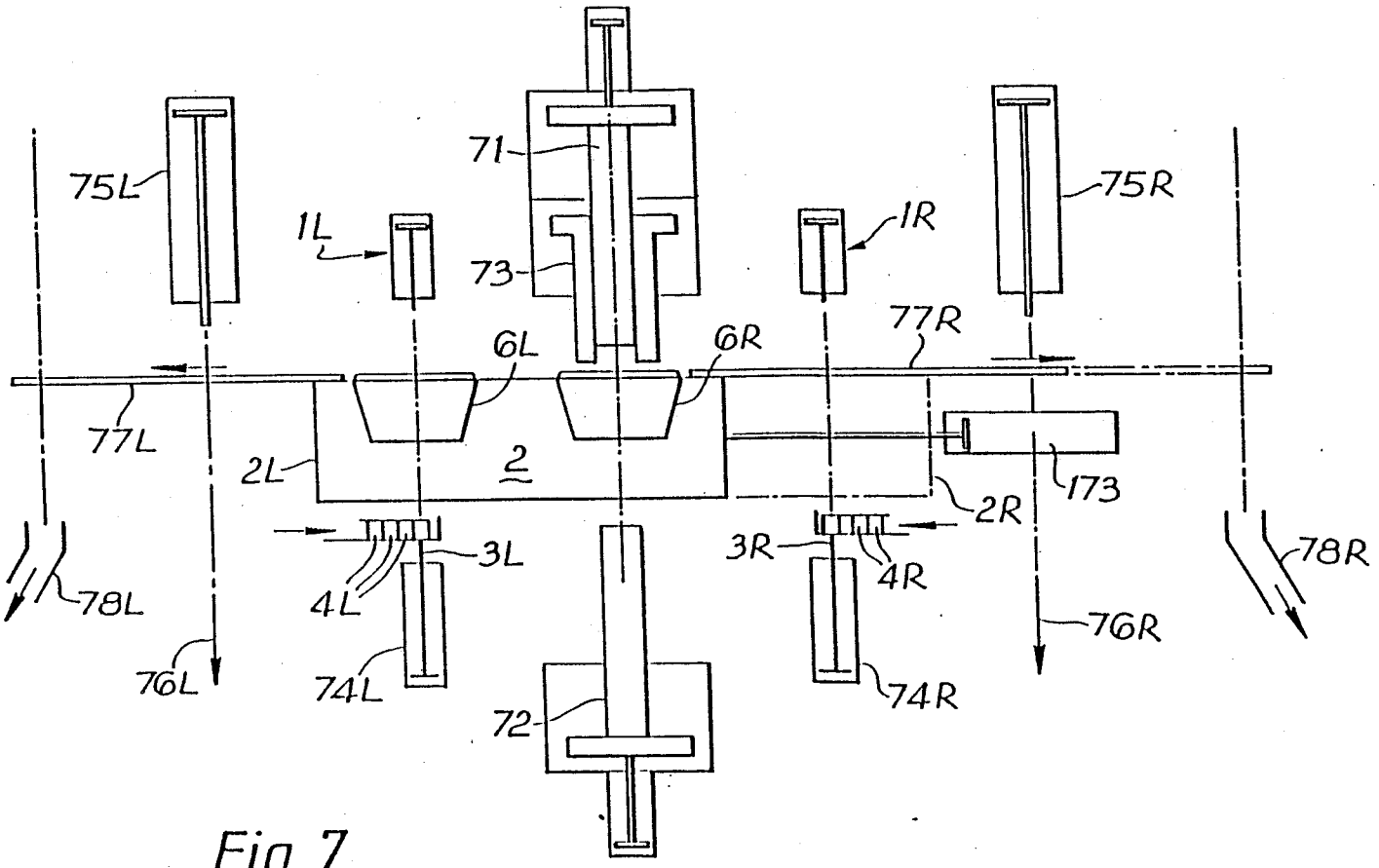
FIG. 7 is a vertical section through a production plant for such inner members, incorporating two sets of ejection/load apparatus of the type shown in FIGS. 1 to 6.

As shown only in FIGS. 5 and 6, the die 6 has spring loaded buttons 63, resiliently biased radially inwardly of the bore 61 of the die 6, for preventing the fresh billet 4 from dropping axially out of the die 6 when the plunger 3 is retracted. The buttons 63 are cammed radially outwardly by the external surface of the billet 4 as the billet is inserted into the die 6 from below, and then spring radially back to their normal positions as shown. Other means for retaining the billet in the die cavity could be provided instead of the buttons 63.

The apparatus shown in FIG. 7, for producing the inner members 5, will now be described in detail. A forming press comprising top 71 and bottom rams 72 and a clamp ram 73 is disposed at a central forming station. To each side of the press there are three other stations, comprising an ejection/load station 1L, 1R, a piercing station 75L, 75R and an exit station comprising an exit chute 78L, 78R, disposed in mirror image on each side of the forming station. The die block 2 has recesses for accommodating two identical segmented dies 6L, 6R of the type shown in FIGS. 1 to 6, the die block 2 being reciprocable horizontally by an hydraulic drive mechanism 173 between a left hand position 2L, at which the right hand die 6R is at the forming station, as shown in FIG. 7, and a right hand position 2R (shown in broken lines in FIG. 7) at which the left hand die 6L is at the forming station. Left hand 77L and right hand 77R feed plates are reciprocable horizontally with the die block 2 for conveying successively ejected inner members 5 to the respective piercing stations and exit chutes. Left hand and right hand billet feeders convey fresh billets 4L, 4R seriatim to the respective ejection/load stations for engagement by the respective plungers 3L, 3R, which plungers are driven by hydraulic plunger mechanisms 74L, 74R.

The press cycle is as follows. With the apparatus at the position shown in FIG. 7, the left hand die 6L is positioned at the left hand ejection/load station 1L, while the right hand die 6R is positioned at the press 71, 72, 73. At the ejection/load station 6L, a fresh billet 4L is fed into the die 6L by the plunger 3L. The incoming billet ejects the inner member 5 which has already been formed within the die cavity in the die 6L, in a manner to be described in greater detail below with reference to FIGS. 1 to 6. While this is happening, the press 71, 72, 73 forms a component in the right hand die 6R. To form a component, the clamp ram 73 closes onto the die, and the top and bottom main rams 71, 72 then out-stroke synchronously thus forming a new inner member 5 within the die cavity. The top and bottom rams 71, 72 and the clamp ram 73 then retract, leaving the formed inner member within the die cavity.

The die block is then moved to the right hand position 2R. This moves the left hand die 6L to the press 71, 72, 73, and the right hand die 6R to the right hand load/eject station 1R. Simultaneously, then, the finished component can be ejected and a fresh billet loaded into the right hand die 6R, whilst a component is formed by the press in the left hand die 6L. The die block is then transferred back to the left hand position 2L and the cycle recommenced. One component is formed at every press stroke while another is loaded/ejected.

Simultaneously with movement of the die block to the right, the right hand feed plate 77R, which is attached to the die block, transfers an inner member 5, previously formed in the right hand die 6R, from the right hand load/eject station 1R to the adjacent right hand piercing station 75R. The piercing station operates simultaneously with the operation of the top and bottom rams to pierce the central bore of the inner member 5, the waste material dropping 76R clear of the apparatus.

Further, simultaneously with the movement of die block to the right, the right hand feed plate 77R transfers a finished inner member 5, previously pierced at the right hand piercing station 75R, to an exit chute 78R.

Anologously, with every movement of the die block from the right hand position 2R to the left hand position 2L, the left hand feed plate 77L transfers an ejected component 5 from the left hand load/eject station 1L to the left hand piercing station 75L, and a previously pierced component 5 from the station 75L to the chute 78L.

Thus, between every press operating stroke, at every die block movement, an inner member is transferred outwards from the centre line by the action of the feed plates, transporting the inner member to the piercing station and then to the exit chute. At every operating stroke of the press, an inner member is:

(a) formed at the forming station;
(b) ejected at either the left hand or the right hand ejection/load station;
(c) pierced at either the left hand or the right hand piercing station; and
(d) deposited in either the left hand or the right hand exit chute.

The function of the ejection/load apparatus will now be described in greater detail with reference to FIGS. 1 to 6, which show one cycle of operation of the apparatus in successive stages.

As shown in FIG. 1, a formed inner member 5, locked in the die 6 against relative axial movement, is positioned on the vertical axis 100 at the ejection/load station. The die-retaining annulus 14 is held in its retracted position by air pressure in chamber E supplied through the first port P1. The camming piston 40 is fully retracted within the intermediate cylinder 30, which in turn is fully retracted within the stationary main body member 23, by withdrawing air from the chamber A through the part not shown, and from chambers B, C through the second port P2. A fresh billet 4 is fed to the plunger 3 and held against the head of the plunger by the magnet 300.

As shown in FIG. 2, air is released from chamber E through the first port P1, so that the compression springs 132 force the die-retaining annulus 14 into engagement with the die 6. Simultaneously, air under pressure is forced through the second port P2, causing the chambers B and C to expand to their fullest extent possible. Chambers B and C are in communication, so that the pressure is equalised. Simultaneously air is supplied to chamber A through its port not shown. However, the pressure of the air in the annular chamber F remains at atmospheric pressure. The force tending to drive the camming piston 40 downwards derives from the air pressure in chamber C, and is greater than the force exerted by spring 53.

The inner piston 50 is fully extended, by virtue of the action of the compression spring 53, and projects downwardly from the cone portion 42 of the camming piston 40 and into the bore 62, 61 of the die. The button 51 engages in the corresponding cylindrical bore of the inner member 5, while the cone portion 42 just enters the tapered part 62 of the die bore 61.

As shown in FIG. 3, the plunger 3 then rises through the bore 200 of the die block 2 to insert the fresh billet 4 into the bore 61 of the die 6, the tapered lower end 64 of the bore assisting in locating the billet 4 in the bore. Pneumatic pressure is maintained in the chambers A, B and C.

The billet 4 engages the undersurface of the inner member 5*a* which is locked in the die 6. Continued upward movement of the plunger 3 therefore has the effect of lifting the die 6 vertically axially out of the die block 2, to the position shown as 6*a* in FIG. 3. Simultaneously, the die-retaining annulus 14 retracts against the action of the compression springs 132, steadying the segments of the die 6. Simultaneously, the die 6 forces the camming piston 40 to retract within the intermediate cylinder 30, 33, against the force exerted by air in chamber C, until the body portion 41 of camming piston 40 abuts undersurface of intermediate cylinder 30. At this point, the inner piston 50 is still fully projecting, and in contact with the inner member 5*a*.

Continued upward movement of the plunger 3 causes the inner member 5*a* to rise relative to the camming surface 42 of the cone portion 42, since the force exerted by the air spring formed by the main chamber A is sufficient to force the die segments apart. Naturally, any unusual resistance to separation of the die segments would be accommodated by compression of the air in chamber A, avoiding damage to the apparatus.

Thus the die segments are separated in stages illustrated in FIG. 3 with broken lines 6*a*, 6*b* and 6*c*, the corresponding positions of the inner member 5 being shown by broken lines 5*a*, 5*b* and 5*c* respectively. Once the die segments have separated so far that the inner member 5*c* is clear of them, the die segments are free to drop back into their appropriate positions in the die block 2, as shown in FIG. 4. This process is made more rapid and more reliable by the action of the die-retaining annulus 14 which provides a continuous resilient bias downwardly on the segments. The annulus 41 reduces the tendency of the die segments to vibrate and to adopt any asymmetric configurations.

As the inner member 5 moves upwardly relative to the die segments, it is guided by the inner piston 50 which, together with the action of the fresh billet 4 on its underside, ensures that it stays on the vertical axis 100. The button 51 prevents any transverse movement. During such axial movement of the inner member 5 relative to the die segments, the inner piston 50 retracts within the camming piston 40, compressing the compression spring 53, which is substantially weaker than the air spring formed by the pneumatic chamber A.

As shown in FIG. 4, the plunger 3 rises to its uppermost position such that intermediate cylinder 33 is lifted clear of the annular shoulder 26, against the action of the air spring in chamber A. This ensures that the inner member 5 is completely released from the die. After the die segments have dropped back into their positions in the die block 2, the inner member 5 is held above the die segments, supported on the fresh billet 4 and prevented from moving laterally by button 51.

Plunger 3 is then retracted, and the position shown in FIG. 5 is reached. Air pressure has been maintained in chamber A (although not necessarily the maximum air pressure hitherto applied) causing the intermediate member 30, 33 to lower until shoulder 26 is abutted. Air pressure maintained in chambers B, C causes the camming piston 40 to be biased downwardly to hold the finished inner member 5 down on the upper surface of the segments of the die 6, and the fresh billet 4 drops back into the bore 61 of the die. The spring loaded buttons 63 prevent the fresh billet 4 from dropping downwardly out of the die.

As a possible alternative to the maintenance of air pressure in the chamber A at this stage, such pressure may be released as a result of which the intermediate member 30, 33 would assume an upwardly displaced position by virtue of air or coil springs 35. In this case, the inner piston 50 would move downwardly, by virtue of spring 53, relative to the camming piston 40 and would still engage the inner member 5 to hold it on the die segments. In fact, it does not matter what position is assumed by the intermediate member 30, 33 at this stage since the overall range of travel of inner piston 50, which is biased downwardly within camming piston 40 itself biased downwardly by air pressure in chamber C, is sufficient to ensure the inner member 5 is held down on the die segments.

Air pressure is now applied to chamber E by way of port P1, to raise the die-retaining annulus 14. This gives clearance for the die block and the appropriate feed plate 77L, 77R (seen in FIG. 7) to move horizontally whilst the button 51 holds the inner member 5 stationary. The appropriate feed plate would be provided with a formation to engage with and then hold the inner member 5, to remove the inner member from the ejection/load station with the next movement of the die block in the opposite direction.

Before the inner member 5 can be thus removed, the ejection/load apparatus must be completely disengaged therefrom. This is achieved by releasing air from chambers A, B and C whereupon the intermediate member 30, 33 and the camming piston 40 are raised by the action of coil or air springs 35. This lifts the button 51 clear of the member 5, the position shown in FIG. 1 then being returned to.

The spring loaded buttons 63 are of such a strength that they are unable to resist the camming action of the billet 4 during the upward stroke of plunger 3, but they are capable of resisting the attraction of the permanent magnet 300 on the plunger 3, in combination with the weight of the billet 4, during the downward stroke of the plunger 3.

What is claimed is:

1. Apparatus for use in die-forming components, comprising:

a segmented die (6) comprising a number of circumferentially disposed segments defining an axial bore (61) between end faces thereof shaped to receive successive billets (4), and a transversely-extending cavity (500) communicating with the bore into which the billet (4) flows under axial compression as a component (5) is formed;

a die block (2) shaped to receive the die;

ejection/load apparatus for ejecting a formed component (5) from the die (6) and reloading the die with a corresponding fresh billet from which another component is to be formed, comprising means for feeding a fresh billet (4) to one end of the said bore (61) with the die block positioned at an ejection/-load station, and means (3) for plunging the fresh billet through the bore (61) to abut against one of said components (5) formed and locked in the die thus to force the die partially out of the die block to permit separation of the die segments, and, on separation of the die segments sufficiently to release the component (5) from the die, to plunge the fresh billet (4) further in the same direction through the opened die to push the component free of the die and permit the die to return to the die block;

and means (77) for removing the freed component (5) from the ejection/load apparatus (1) once the die (6) has returned to its closed state received in the die block (2).

2. Apparatus for forming components from corresponding billets, comprising apparatus according to claim 1, and a press (71, 72, 73) for forming one of said components within the die with said die received in said die block, by compressing one of said billets axially so that it flows into said cavity.

3. Apparatus according to claim 2, wherein the press (71, 72, 73) is remote from the said ejection/load apparatus (1), and further comprising means (173) for conveying the die block (2) between the press and the ejection/load apparatus.

4. Apparatus according to claim 3 wherein said die block (2) receives two of said dies (6L, 6R), and a respective ejection/load apparatus (1L, 1R) is positioned at each side of the press (71, 72, 73) so that one die is able to be positioned at the press while the other die is at one of the ejection/load apparatuses.

5. Apparatus for ejecting a die-formed component (5) from a segmented die (6) positioned at an ejection/load station and reloading the die with a fresh corresponding billet (4) from which another component is to be formed, the die (6) comprising a number of circumferentially disposed segments received in a die block (2) and defining an axial bore (61) between end faces thereof shaped to receive successive billets, and a transversely-extending cavity (500) communicating with the bore into which the billet flows under axial compression as the component is formed, the apparatus comprising:

means for feeding the fresh billet to one end of the said bore;

means (3) for plunging the fresh billet (4) axially through the bore (61) to abut against the component (5) formed and locked in the die thus to force the die (6) partially out of the die block (2) to permit separation of the die segments, and, on separation of the die segments sufficiently to release the component (5) from the die, to plunge the fresh billet (4) further in the same axial direction through the opened die to push the component free of the die and permit the die to return to the die block.

6. Apparatus according to claim 5 further comprising means (40, 50) for engaging and resiliently biasing the component (5) axially towards the die centre, in opposition to the direction of action of the plunging means (3), to force the fresh billet (4) into the bore (61), and the component onto an end face of the die adjacent one end of the bore, once the component has been freed from the die.

7. Apparatus according to any one one of the preceding claims, further comprising cam means (40, 41, 42) for separating the die segments upon movement of the die axially of its bore and outwardly of the die block.

8. Apparatus according to claim 7, wherein the cam means comprises a cam surface (41) tapering axially, whose narrower end is engageable in one end of the bore.

9. Apparatus according to claim 8, wherein the cam surface is formed on one end of a camming piston (40, 41) driveable by a cylinder axially towards the die block.

10. Apparatus according to claim 9 as appendant to claim 6, wherein the camming piston (40, 41) forms the said resilient biasing means which acts on the die-formed component.

11. Apparatus according to claim 10, wherein the camming piston (40, 41) carries an inner piston (50) capable of axial movement relative to the camming piston and resiliently biased relative to the camming piston into engagement with the said component.

12. Apparatus according to claim 11, wherein the inner piston (50) has an end formation (51) for engaging the said component and for steadying the component against transverse movement during the separation of the die segments and the freeing of the component therefrom.

13. Apparatus according to claim 9 wherein the said cylinder is itself axially resiliently biased towards the die block, relative to a frame (20) which is fixed in relation to the ejection/load station.

14. Apparatus according to claim 1 or 5 wherein the ejection/load apparatus further comprises means (14, 132) for resiliently biasing the die segments axially into the die block, in opposition to the direction of action of the plunging means, positively to return the die to its closed state in the die block once the component has been freed from the die.

15. A method of ejecting a die-formed component from a segmented die and reloading the die with a fresh corresponding billet, the die resting in a die block and having a bore between end faces thereof shaped to receive successive billets, and transversely-extending cavities communicating with the bore into which the billet flows under axial compression, comprising:

feeding a fresh billet to one end of said bore;

plunging the fresh billet through the bore to abut against a component formed and locked in the die and thus to force the die partially out of the die block;

separating the die segments sufficiently to release the component from the die, and continuing to plunge the fresh billet further in the same direction through the opened die to push the component free of the die;

allowing the die to return to its closed state resting in the die block with the fresh billet held in the said bore;

and removing the freed component.

16. A method of forming components from corresponding billets in a segmented die having a bore between end faces thereof shaped to receive successive billets, and transversely-extending cavities communicating with the bore into which the billet flows under axial compression, comprising the steps of:

(a) forming a component within the die by compressing a billet axially so that it flows into said cavities, said die resting in a die block;

(b) feeding a fresh billet to one end of said bore;

(c) plunging the fresh billet through the bore to abut against the said component and thus to force the die partially out of the die block;

(d) separating the die segments sufficiently to release the component from the die, and continuing to plunge the fresh billet further in the same direction through the opened die to push the component free of the die;

(e) allowing the die to return to its closed state resting in the die block with the fresh billet held in the said bore;

(f) removing the freed component; and (g) cyclically repeating steps (a) to (f) above with successively-loaded billets.

* * * * *